US011732931B2

(12) United States Patent
Bartlett et al.

(10) Patent No.: US 11,732,931 B2
(45) Date of Patent: Aug. 22, 2023

(54) PNEUMATIC DRIVE CRYOCOOLER

(71) Applicant: Edwards Vacuum LLC, Sanborn, NY (US)

(72) Inventors: Allen J. Bartlett, Chelmsford, MA (US); Matteo F. Salvetti, Chelmsford, MA (US); Sergei Syssoev, Chelmsford, MA (US); Mark A. Stira, Chelmsford, MA (US)

(73) Assignee: Edwards Vacuum LLC, Sanborn, NY (US)

( * ) Notice: Subject to any disclaimer, the term of this patent is extended or adjusted under 35 U.S.C. 154(b) by 30 days.

(21) Appl. No.: 17/527,750

(22) Filed: Nov. 16, 2021

(65) Prior Publication Data

US 2022/0074628 A1 Mar. 10, 2022

Related U.S. Application Data

(62) Division of application No. 17/046,148, filed as application No. PCT/US2019/025945 on Apr. 5, 2019, now Pat. No. 11,209,193.

(Continued)

(51) Int. Cl.

| | |
|---|---|
| ***F25B 49/02*** | (2006.01) |
| ***F25B 9/14*** | (2006.01) |
| ***F25B 41/20*** | (2021.01) |

(52) U.S. Cl.

CPC ..... *F25B 9/14* (2013.01); *F25B 41/20* (2021.01); *F25B 49/02* (2013.01); *F25B 2309/1428* (2013.01); *F25B 2321/00* (2013.01)

(58) Field of Classification Search

CPC .... F25B 9/14; F25B 41/20; F25B 2309/1428; F25B 2321/00

See application file for complete search history.

(56) References Cited

U.S. PATENT DOCUMENTS 2,906,101 A 9/1959 McMahon et al.
2,966,035 A 12/1960 Gifford (Continued)

FOREIGN PATENT DOCUMENTS

CN 105222386 A 1/2016
JP H0545015 A 2/1993

(Continued)

OTHER PUBLICATIONS

File history of corresponding U.S. Appl. No. 17/046,148, including: Notice of Allowance dated Aug. 25, 2021, Amendment dated Jul. 22, 2021 and Office Action dated Jan. 27, 2021.

(Continued)

*Primary Examiner* — David J Teitelbaum

(74) *Attorney, Agent, or Firm* — Theodore M. Magee; Westman, Champlin & Koehler, P.A.

(57) ABSTRACT

A Gifford-McMahon cryogenic refrigerator comprises a reciprocating displacer within a refrigeration volume. The displacer is pneumatically driven by a drive piston within a pneumatic drive volume. Pressure in the pneumatic drive volume is controlled by valving that causes the drive piston to follow a programmed displacement profile through stroke of the drive piston. The drive valving may include a proportional valve that provides continuously variable supply and exhaust of drive fluid. In a proportionally controlled feedback system, the valve into the drive volume is controlled to minimize error between a displacement signal and a programmed displacement profile. Valving to the warm end of the refrigeration volume may also be proportional. A passive force generator such as a mechanical spring or magnets may apply force to the piston in opposition to the driving force applied by the drive fluid.

18 Claims, 16 Drawing Sheets

Related U.S. Application Data

(60) Provisional application No. 62/655,093, filed on Apr. 9, 2018.

(56) References Cited

U.S. PATENT DOCUMENTS

| | | | | |
|---|---|---|---|---|
| 3,188,819 | A | 6/1965 | Hogan | |
| 3,188,821 | A | 6/1965 | Chellis | |
| 3,218,815 | A | 11/1965 | Chellis et al. | |
| 3,620,029 | A | 11/1971 | Longsworth | |
| 3,625,015 | A | 12/1971 | Chellis | |
| 3,733,837 | A | 5/1973 | Lobb | |
| 4,543,793 | A * | 10/1985 | Chellis | F25B 9/14 62/226 |
| 4,862,695 | A | 9/1989 | Kushnir | |
| 4,972,346 | A | 11/1990 | Kawano et al. | |
| 5,392,607 | A * | 2/1995 | Wu | G05D 19/02 318/646 |
| 6,256,997 | B1 | 7/2001 | Longsworth | |
| 8,448,461 | B2 | 5/2013 | Longsworth | |
| 2009/0084115 | A1 | 4/2009 | Yuan et al. | |
| 2011/0126554 | A1 * | 6/2011 | Morris | F25B 9/10 62/6 |
| 2021/0033314 | A1 | 2/2021 | Bartlett et al. | |

FOREIGN PATENT DOCUMENTS

| | | | |
|---|---|---|---|
| JP | 2006161800 | A | 6/2006 |
| JP | 2014035098 | A | 2/2014 |
| WO | 9429653 | A1 | 12/1994 |

OTHER PUBLICATIONS

Korean Office Action dated Feb. 3, 2021 for corresponding Korean application Serial No. 2020-7028647.

Notification of Transmittal of the International Preliminary Report on Patentability dated May 19, 2020 for corresponding PCT application Serial No. PCT/US2019/025945, 17 pages.

International Search Report dated Jun. 24, 2019 for corresponding PCT application Serial No. PCT/US2019/025945, 3 pages.

International Written Opinion dated Jun. 24, 2019 for corresponding PCT application Serial No. PCT/US2019/025945, 5 pages.

Chinese Office Action and Search Report dated Aug. 5, 2022 for corresponding Chinese application Serial No. 108112201, 24 pages.

Japanese Notification of Reason for Rejection dated May 9, 2022 for corresponding Japanese application Serial No. 2020-555167, 4 pages.

* cited by examiner

PNEUMATIC DRIVE CRYOCOOLER

RELATED APPLICATION

This present application is a divisional application of and claims priority of U.S. patent application Ser. No. 17/046,178, filed Oct. 8, 2020, which is a Section 371 National Stage Application of International Application No. PCT/US2019/025945, filed Apr. 5, 2019, and published as WO 2019/199591 A1 on Oct. 17, 2019, the content of which is hereby incorporated by reference in its entirety and which claims priority of U.S. Provisional Application No. 62/655,093, filed on Apr. 9, 2018. The entire teachings of the above application are incorporated herein by reference.

BACKGROUND

In Gifford-McMahon (GM) type refrigerators such as disclosed in U.S. Pat. Nos. 2,906,101 and 2,966,035, high pressure working fluid such as helium is valved into the warm end of a refrigeration volume in a cylinder. Then the fluid is passed through a regenerative matrix by pressure differential and movement of a displacer piston, which may carry the regenerative matrix, toward the warm end. Fluid is cooled as it passes through the regenerative matrix. The fluid is then expanded and further cooled at the cold end of the displacer piston with exhaust of the fluid from the warm end through an exhaust valve. The displacer piston is moved back toward the cold end of the refrigeration volume to cool the regenerative matrix as fluid flows through. In the original Gifford patent, the piston was driven by a crank from a rotary motor and valves to the warm end of the cylinder were controlled by the same rotary drive to synchronize piston movement with valving. See also U.S. Pat. No. 3,625,015 in which a rotary motor controls rotary valves and, through a scotch yoke, drives a displacer piston in linear movement. That approach carries through today to most GM refrigerators.

There have for many years existed in the market GM refrigerators that rely on pneumatic forces to cause the displacer to reciprocate within the refrigerator cylinder. See for example U.S. Pat. Nos. 3,620,029 and 6,256,997. Those designs may experience force imbalances on the displacer that cause the displacer to hit the bottom or top of the cylinder. Those force imbalances may arise as parasitic forces change over time, such as frictional or viscous forces. U.S. Pat. No. 6,256,997 proposed the use of energy absorbing bumper pads to absorb the energy of displacer impact upon the cylinder. The impact, however, still results in unwanted vibration and other detrimental functional characteristics.

Pneumatic drive designs utilizing valves to control fluid flow to a pneumatic drive volume have been proposed. U.S. Pat. Nos. 3,188,819, 3,188,821 and 3,218,815 proposed control of valve timing by mechanical devices such as cams. In one approach, cams associated with spool valves were driven by a disk on a rod extending from a refrigerator displacer. In other embodiments, spool valves were pneumatically controlled through ports associated with the displacer. In each case, the valve and displacer were closely associated structurally and timing of valves was not readily adjusted. U.S. Pat. No. 3,188,821 additionally suggested an embodiment in which a spool valve was controlled by a solenoid independent of the displacer position. More recently, U.S. Pat. No. 4,543,793 proposed a pneumatic drive in which valving to the pneumatic drive volume was controlled by an electronically driven spool valve responsive to displacer position. Practical implementations are not known to have resulted from those valved pneumatic drive systems.

The discussion above is merely provided for general background information and is not intended to be used as an aid in determining the scope of the claimed subject matter. The claimed subject matter is not limited to implementations that solve any or all disadvantages noted in the background.

SUMMARY

A cryogenic refrigerator comprises a refrigeration volume that comprises one or more interconnected expansion chambers having warm and cold ends and a reciprocating displacer within the refrigeration volume. A drive piston in a pneumatic drive volume at the warm end of the refrigeration volume is coupled to the displacer. Refrigeration volume valving controls cyclic supply and exhaust of a pressurized refrigerant gas to and from the warm end of the refrigeration volume. Drive valving provides supply and exhaust of drive fluid to and from the pneumatic drive volume. An electronic controller controls the drive valving with a drive control signal, of one or more inputs, that varies through stroke of the drive piston to cause the drive piston to follow a programmed displacement profile through stroke of the drive piston.

The cryogenic refrigerator may include a displacement sensor responsive to movement of the drive piston or displacer to provide a displacement signal, and the electronic controller may control the drive valving to minimize error between the displacement signal and the programmed displacement profile through stroke of the drive piston. The cryogenic refrigerator further comprises a passive force generator that applies force to the piston in opposition to the driving force applied by the drive fluid.

The drive valving may be proportional drive valving that provides continuously variable supply and exhaust of drive fluid in proportion to the drive control signal from the electronic controller. Alternatively, the electronic controller may open and close the drive valving to respective supply and exhaust lines at sufficient rate to provide variable control of pressure between supply and exhaust pressures in the pneumatic drive volume.

The passive force generator may be a spring, and the spring may comprise two or more spring elements positioned either inside or outside of the drive volume and coupled to the piston through a shaft. Alternatively, the passive force generator may comprise magnets.

The drive piston may separate the pneumatic drive volume into a proximal drive chamber proximal to the displacer and a distal drive chamber distal from the displacer. The drive valving may supply and exhaust drive fluid to and from the distal drive chamber. The drive valving may also or alternatively supply and exhaust drive fluid to and from the proximal drive chamber. Alternatively, the proximal drive chamber may be directly coupled to a drive fluid exhaust or be in fluid communication with the warm end of the refrigeration volume.

The refrigeration volume valving may also comprise proportional valving that provides continuously variable supply and exhaust of refrigerant gas to the refrigeration volume in proportion to an electronic refrigerant control signal. The drive fluid may be valved from the same refrigerant supply and return lines.

In addition to or as an alternative to displacement feedback control, the electronic controller may further provide adaptive feedforward control.

The summary is provided to introduce a selection of concepts in a simplified form that are further described in the detailed description. This summary is not intended to identify key features or essential features of the claimed subject matter, nor is it intended to be used as an aid in determining the scope of the claimed subject matter.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION

Figure 1A:
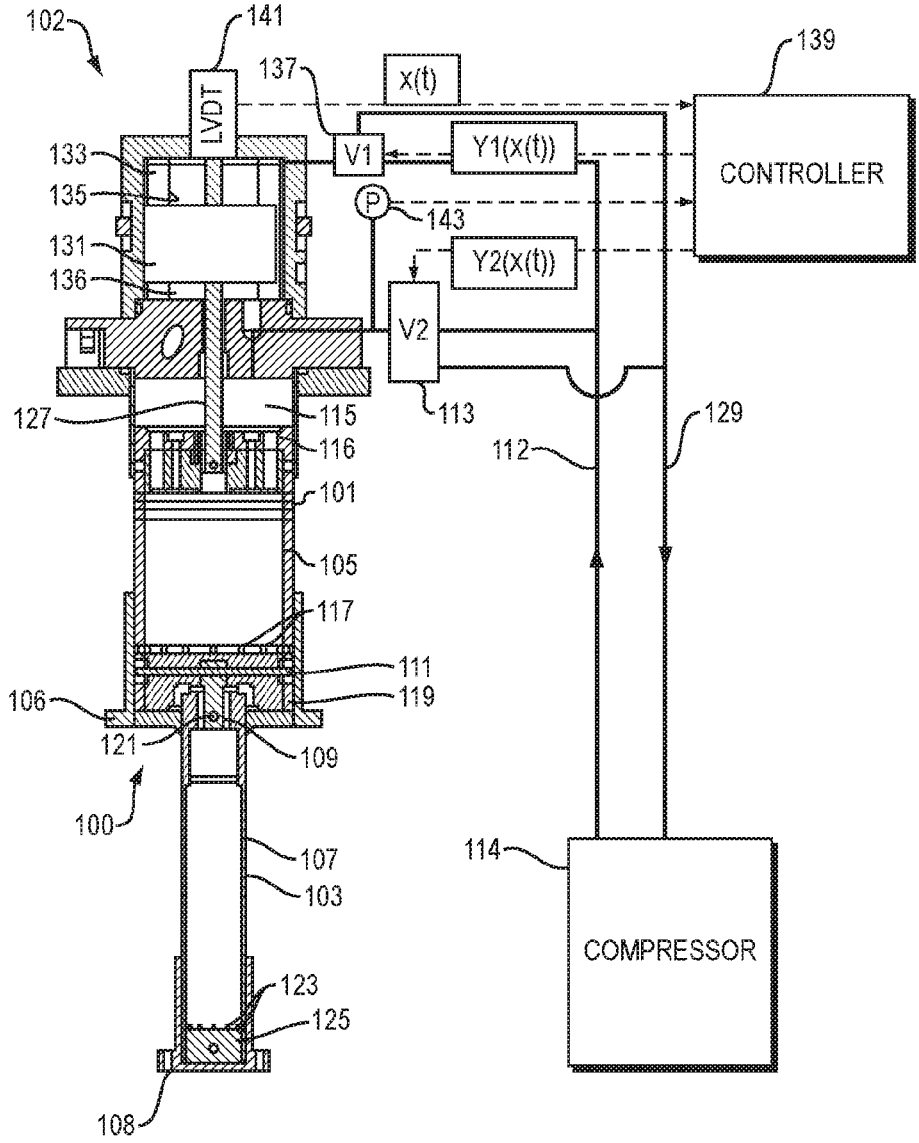
FIG. 1A is a cross-sectional view of an embodiment of the invention.

A description of example embodiments follows.

Current implementations of the dominant motor-driven Gifford-McMahon (GM) cryocoolers are characterized by certain performance limitations:

1) Parasitic magnetic fields generated by the high torque motor that may require electromagnetic shielding of the cryocooler to ensure proper application performances;
2) Use of magnetic materials inherent in electrical motors that can distort the primary magnetic field required by a specific application (e.g., MRI and NMR);
3) Direct coupling of the displacer body to the drive motor via a scotch-yoke mechanism that can result in significant mechanical vibrations detrimental for the application (e.g., MRI and NMR);
4) Direct coupling of displacer and motor that can result in undesired acoustic emissions;
5) The direct mechanical linkage between the displacer position and the Helium (He) inlet/exhaust valve timing that prevents the optimization of the refrigerator capacity and efficiency;
6) The refrigeration capacity not being adjustable so as to provide just the amount of refrigeration needed to offset the thermal load on the system, thereby only consuming the electrical energy that is needed for the specific application;
7) The size and weight of the traditional motor drive of a GM refrigerator that make field replacement difficult;
8) Limited cryocooler tunability to the specific application that results in application specific design solutions;
9) Considerable wear of the seal and bushing components that limit the lifetime of the cryocooler.

Depending on the specific application that the GM cryocooler is serving (cryopumps for the semiconductor industry, MRI/NMR, and others), the above limitations can become serious limiting factors to the customer's application.

Solutions presented here are intended to reduce or eliminate the limitations described above. Disclosed embodiments eliminate the motor drive and scotch-yoke mechanisms by replacing them with an actively controlled pneumatic drive equipped with electronic control valves. Pneumatically driven refrigerators offer the benefits of reduced vibration, reduced magnetic material, reduced acoustics, reduced size and weight, improved thermodynamic cycle efficiency and other benefits advantageous to applications such as MRI.

The disclosed pneumatic drive design can be smaller than the typical current motor drive both in size and weight. The pneumatic force may be provided by diverting some of the helium refrigerant gas flow coming from the compressor. The gas is used to fill one or more chambers in a drive volume, and the resulting force developed in the drive volume is balanced against the pneumatic and frictional/dissipative forces developed in the thermodynamic (TD) refrigeration volume comprising one or more expansion chambers in which the displacer reciprocates. The pressure/force balance is controlled by electronic valves which, in certain embodiments, are cost effective proportional spool valves that regulate the inlet and exhaust of gas into the drive volume and the TD expansion volumes. A position sensor may be used to detect the position of the displacer and, based upon the displacer position (and possibly the TD volume pressure with the additional use of a pressure sensor), the drive volume pressure is adjusted to cause controlled motion of the displacer. Because the displacer is not mechanically connected to the valve actuation mechanism, unlike the conventional GM refrigerator where the position of the displacer is linked mechanically to the valve timing, it is possible to control the linear distance traveled by the displacer throughout a thermodynamic cycle independent of when the valves that control the helium flow in and out of the TD volume are actuated. In this way, the pressure-volume (PV) diagrams of the refrigerator can become highly adjustable; the control system can adjust the size of the expansion volume, the rate of change of the size of the expansion volume, as well as the pressure at which the volume is charged according to programmed profiles.

Implementations of the drive may include an appropriately sized axial mechanical spring or magnets that serve as a passive force generator to assist the movement of the displacer determined by the pressure levels in the drive chambers. The force generator can ensure high controllability of the displacer position, including the avoidance of hits at the top and bottom of the cylinder, without the need for sophisticated control algorithms. The force generator can be adjustable. For example, overall spring length/loading of the spring can be adjusted manually or via a motor mechanism (e.g., an electric motor with a screw drive). Also, one or more electromagnets could be used. If the spring/magnets are adjustable, one could refine tuning, e.g., to compensate for manufacturing variances or to optimize the benefits of the passive force generator. Adjustment could be before or during operation of the drive. For example, they could be adjusted on the fly during operation to optimize overall energy consumption.

FIG. 1A presents a detailed cross-sectional view of one embodiment of the invention. In this embodiment, the two stage cold finger 100 may be identical to that of a conventional GM refrigerator. Although shown as a two stage cold finger, the invention is also applicable to a single stage or three or more stage refrigerator. The GM refrigerator is distinguished by a pneumatic drive 102 to be described below.

The two stage cold finger includes a first stage cylinder 101 coupled to a second stage cylinder 103 of a reduced diameter. The first stage cylinder 101 is closed by a heat station 106 that also surrounds the cold end of the cylinder. The second stage cylinder 103 is closed by a second stage heat station 108 that surrounds the cold end of the cylinder. The first stage heat station may be cooled to a temperature range of 55K-100K, for example, while the second stage of the station may be cooled to a temperature of 4K-25K. A first stage displacer piston 105 reciprocates in the first stage cylinder and a second stage displacer piston 107 reciprocates in the second stage. Each piston encloses a regenerative matrix through which gas flows from one end to the other. In refrigeration mode of operation, the gas is cooled as it flows toward the cold end and cools the matrix as it flows back up toward the warm end. The two pistons are coupled to reciprocate together by a rod 109 and pin 111.

In operation, helium refrigerant gas from a compressor 114 is valved from a supply line 112 through a refrigeration volume valve 113 into a warm end volume 115 of the first stage cylinder. Unlike in a conventional GM refrigerator, the valve 113 is not actuated by a rotary motor that also drives the displacer pistons. Although the valve 113 could be driven by displacer movement, it is preferably an electronically controlled valve to be described in greater detail below.

High pressure helium refrigerant gas is introduced into the warm end 115 of the TD volume of the refrigerator. The reciprocating displacer pistons are pulled upward to facilitate the movement of that working gas through the regenerative matrices and fill cold chambers found at the lower ends of the cylinders. The gas flows through ports 116 at the top of the displacer piston 105 into the regenerative matrix chamber of the piston. Gas flows through that regenerative matrix and is cooled. The cooled gas flows into the space between the end 119 of the piston and the heat station 106. In this design, that gas flows from the regenerative matrix through ports 117 into an annulus between the piston and the cylinder and down to the space below the piston 119. The gas then flows through an annulus 121 surrounding the rod 109 into the regenerative matrix within the second stage piston 107. The gas is further cooled in the second stage regenerative matrix before it passes through ports 123 into an annulus about the cold end of the piston 125.

Subsequently, gas exhausted through the valve 113 to the helium return line 129 to the compressor causes expansion of the refrigerant gas in the volumes of the first and second stage pistons. That expansion results in the cryogenic cooling of the heat stations 106 and 108. During exhaust, the displacer pistons are returned to the cold end of the refrigerator to displace gas upwardly through the regenerative matrix to cool the matrix and extract cooling capacity from the working fluid before it exits from the crycooler and returns to the compressor. The cycle then restarts.

Unlike conventional motor driven GM refrigerators, the rod 127 that drives the reciprocating displacer pistons is driven by a piston 131 that reciprocates in a pneumatic volume 133. The piston separates the volume 133 into a distal chamber 135 and a proximal chamber 136 and reciprocates in response to pressure differentials between the two chambers. Alternatively the piston may extend through the entire proximal end of the pneumatic volume, leaving only a distal chamber. Unlike commercial pneumatic drive GM refrigerators, the pressure differential across the piston 131 is controlled by an electronically controlled valve 137. Both of the valves 113 and 137 are controlled by the controller 139 that responds to position of the drive pistons and displacer. The position sensor may be a linear variable displacement transducer (LVDT) 141. The displacement sensor 141 feeds a signal x(t) to the controller which, through feedback control to be described, controls both timing and flow through a valve 137 through signal Y1 (x(t)). Valves 113 and 137 are preferably proportional valves, but may be simple on/off directional valves as long as their speed of actuation allows for sufficient controllability of the timing and the fluid flow in and out of the TD and drive chambers. A proportional valve allows for continuously variable flow level proportional to valve position which is in turn proportional to an electrical input signal Y. In the embodiment of FIG. 1, the pressure of the proximal chamber 136 follows the pressure of the warm end 115 of the TD volume. Other embodiments will be described below.

Another implementation of the position sensor includes permanent magnets embedded at opportune locations in either the piston or displacer body. The varying strength of the magnetic flux lines generated by the magnets at a given position while in motion is detected by a static receiving sensor coil placed on the cryocooler cylinder. A correlation equation is then used to correlate the strength of the magnetic flux with the actual position of the piston/displacer.

An alternative position sensor implementation that has the advantage of being insensitive to the presence of a background magnetic field is based on the use of an optical sensor embedded in either the drive chamber or the TD refrigeration volume. Other position sensors may also be used.

The controller 139 may be a proportional-integral-derivative (PID) controller as will be described in greater detail below. The proportional controller is able to generate an error signal between the displacement signal x(t) and a defined displacement profile and provides a feedback signal Y1 to control the gas flow through the proportional valve 137. That gas flow applies pressure in the distal chamber 135 that drives the piston 131 to minimize the error. The controller also controls the flow of gas into the TD volume in response to a defined pressure versus position profile. The system may also be provided with a pressure sensor 143 to provide pressure feedback to the controller to allow for control of valve 113 through a pressure error.

Figure 1B:
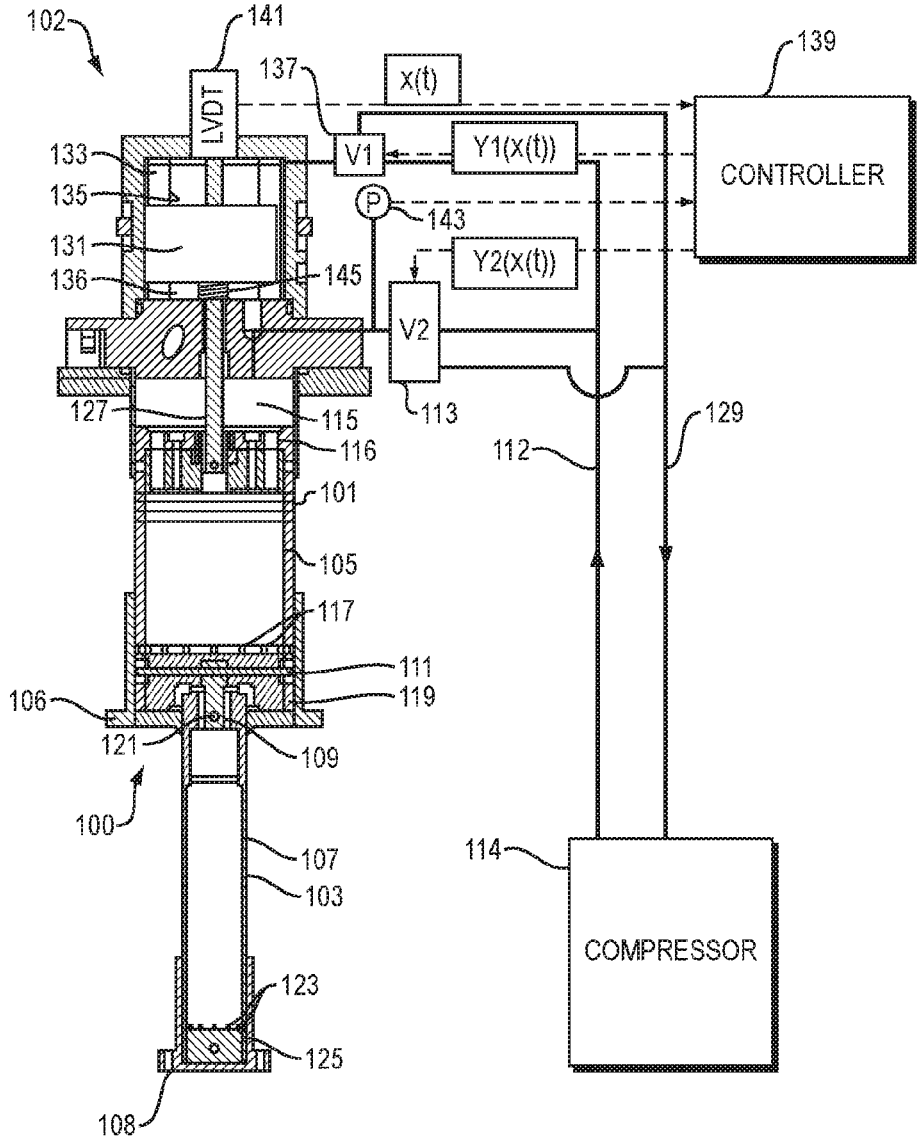
FIG. 1B is alternative embodiment of the invention that further includes a spring as a passive force generator.
Figure 2:
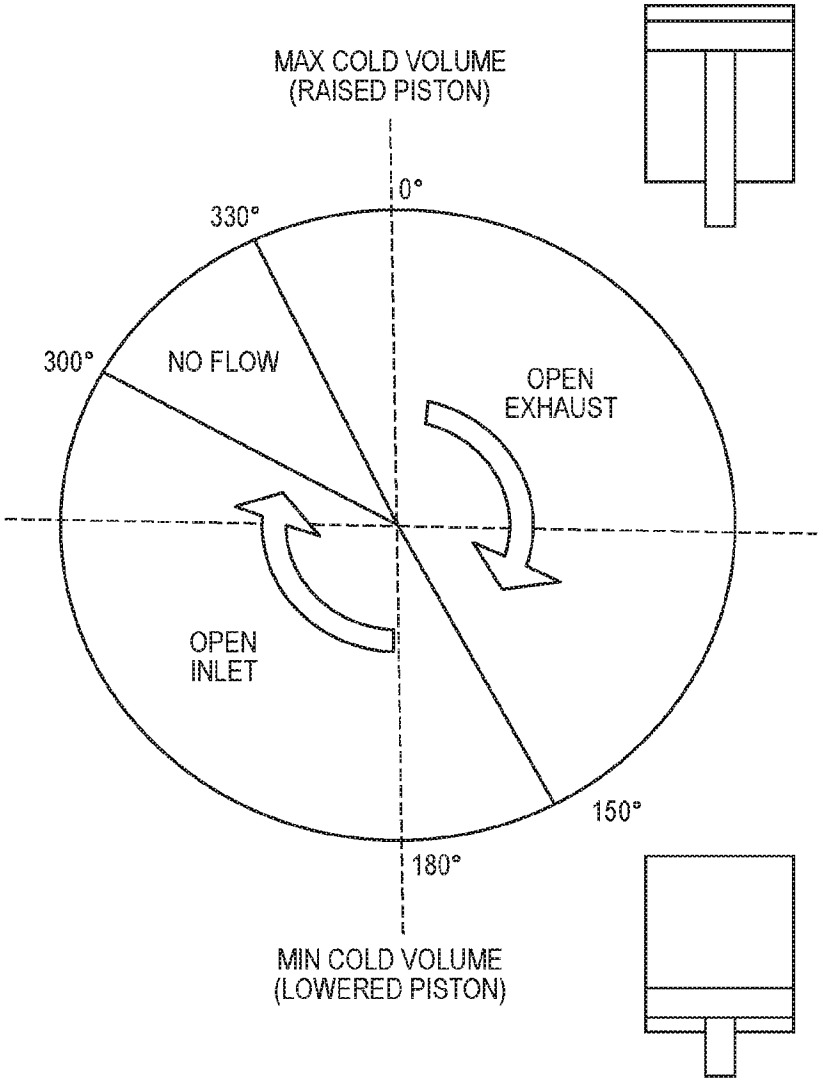
FIG. 2 illustrates valve timing in one embodiment of the invention.

FIG. 2 illustrates an alternative embodiment substantially the same as FIG. 1 except that it additionally includes a passive force generator that applies force to the piston in addition to the existing forces applied on the piston and the displacer assembly. In FIG. 2, that passive force generator is a spring 145 that responds to downward movement of the piston from rest position with upward force in compression and responds to upward movement from the rest position with downward force in expansion. An alternative passive force generator is one or more magnets on the piston and cylinder in magnetic opposition.

The warm valve, that is, refrigeration volume valving, 113 controls the flow of helium in and out of the cryocooler's first and second stage thermodynamic chambers. Through the controller, the warm valve can be actuated to define selected valve opening and closing profiles relative to displacer position for both supply and exhaust. The controller is able to define the periods of the cycle of the displacer during which the valve is proportionally open to the exhaust side (the low helium pressure side), or to the supply side (high helium pressure side), or is closed for no flow through the valve. FIG. 2 illustrates typical timing of the warm valve actuation with respect to the position of the displacer. The warm valve 113 can be either a three way valve or a pair of two-way valves. Preferably, they are proportional valves or on/off valves with sufficiently high actuation speed for variable flow control, but on/off directional valves can be implemented within the proposed control.

The drive valve 137 controls the position of the displacer according to defined trajectory profiles chosen by the user. The drive valve could be either a three-way proportional valve or a pair of two-way proportional valves. On/off valves with sufficiently high actuation speed could also be implemented. The controller enables the user to choose displacer trajectories such as a sinusoidal motion, trapezoidal motion, triangular motion or, in general, any desired profile that can be supported by the force balance equilibrium acting on the displacer and piston assembly. The user inputs a motion profile that specifies the desired position of the displacer at any point in time of the cycle. The position sensor detects the actual position of the displacer; the controller compares sensed position to the desired position at that point in time, computes the position error, and then sends a command to the drive valve 137 to correct the error.

Figure 3:
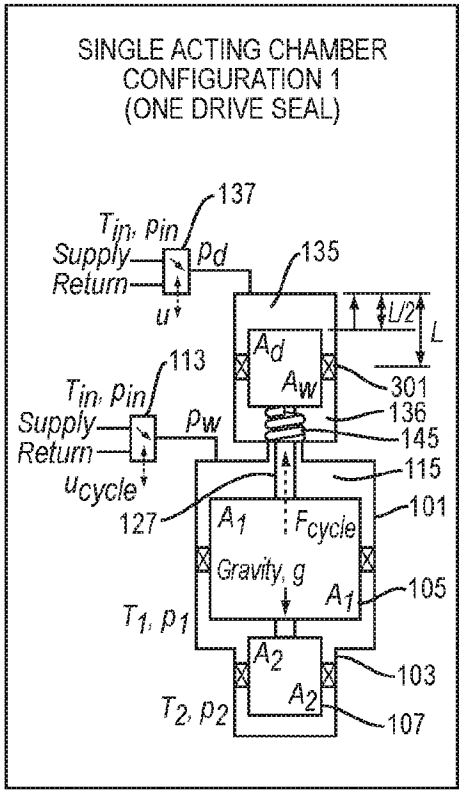
FIG. 3 is a schematic illustration of the embodiment of FIG. 1B in which a proximal drive chamber is in fluid communication with the refrigeration volume.
Figure 4:
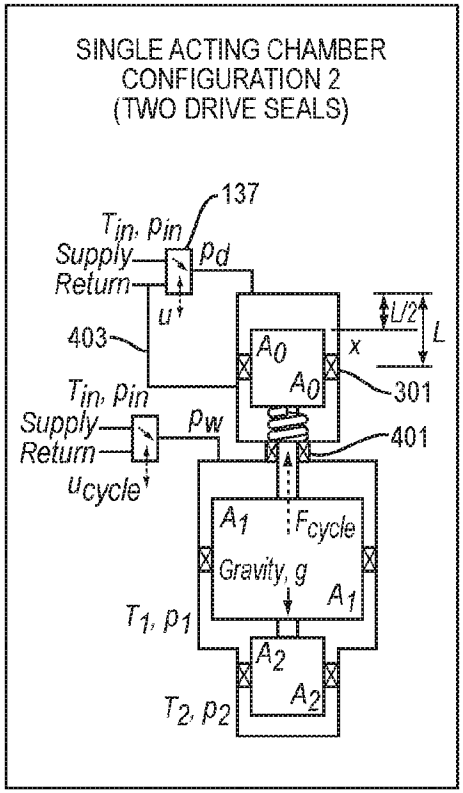
FIG. 4 is a schematic illustration of an alternative embodiment of the invention in which a proximal drive chamber is coupled to exhaust and is not in fluid communication with the refrigeration volume.
Figure 5:
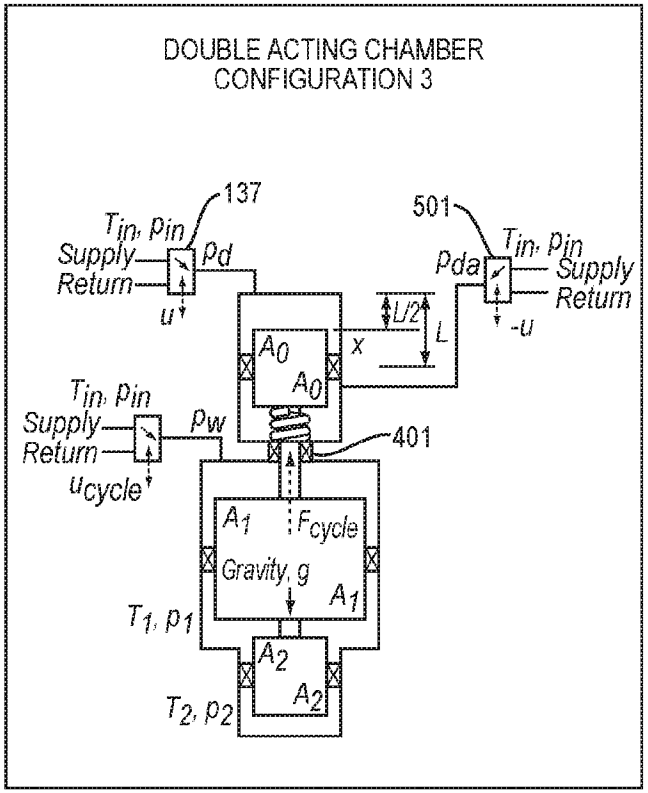
FIG. 5 is a schematic illustration of an alternative embodiment of the invention in which both proximal and distal drive chambers are valved to supply and exhaust.

FIGS. 3-5 are schematic illustrations of alternative implementations of the pneumatic drive in which a piston 131, mechanically linked to the displacer 105, 107, travels along the axial drive direction between upper distal chamber 135 and lower proximal chamber 136 of a pneumatic drive volume 133. The two drive chambers are separated from each other by the piston and a seal 301 at the outer diameter of the piston to minimize any cross-chamber helium leakage.

In FIG. 3, contrary to what is shown in FIG. 1B, the lower drive chamber 136 is directly connected to the cryocooler TD refrigeration volume through a fluid path around the rod 127. Thus, the lower drive chamber is open to the TD refrigeration volume.

This configuration is based on the adoption of a single electronic spool valve 137 that controls the upper drive chamber pressure level. Within this configuration, the pressurization of the lower drive chamber is coupled to the instant pressure level of the TD refrigeration volume and, for this reason, this drive configuration may not allow for a complete controllability of the piston/displacer position at all stages of the thermodynamic cycle. In particular, this configuration may not allow for the operation of the cryocooler as a "heat engine" by modification of the timing between the displacer position and the inlet/exhaust helium flow into the TD refrigeration volume as with the designs of FIGS. 4 and 5. For this reason, physical heaters would likely be used for accelerating the cryocooler warm-up rate or appropriately controlling the first and second stage temperature values and/or cooling capacities. In this implementation, the spring acts as a "return" spring that: a) keeps the piston positioned to the upper side of the drive (at minimum distal drive chamber volume condition) at cryocooler rest conditions and b) generates a returning force on the piston toward the upper side of the drive that is linearly proportional to the axial compression of the spring.

FIG. 4 is a schematic implementation of FIG. 1B. In FIG. 4, the lower drive chamber 136 is separated from the warm end 115 of the TD refrigeration volume by means of a bushing and a seal element 401 located about the piston shaft 127 that links the piston to the displacer. Importantly, the flow of the pressurized helium in and out of the distal drive chamber 135 is regulated by a single electronic spool valve based on a feedback that indicates the real-time displacer position (and possibly an additional feedback based on the pressure level in the TD chamber). Conversely, the pressure of the proximal drive chamber 136 is constantly maintained at the compressor low pressure side level by means of an open helium gas path 403 between the drive chamber 136 and the compressor return pressure side. This configuration is also characterized by the adoption of a "return" spring.

FIG. 5 shows an implementation similar to the one described in FIG. 4 except that the proximal drive chamber 136 is not connected either to the helium compressor return side or the cryocooler TD refrigeration volume. In this configuration, a bushing/seal component 401 placed on the piston shaft isolates the proximal drive chamber 136 from the TD refrigeration volume 115, and two separate electronic valves serve the pneumatic drive unit: one valve 137 dedicated to controlling the helium gas flow to the distal drive chamber 135 and a second valve 501 to control the flow to the proximal drive chamber 136. This solution ensures optimal controllability of the piston position. Finally, this configuration is based on the use of a spring that acts as a "centering" spring by a) keeping the piston positioned centered (mid-point of the stroke) in the drive chamber cylinder during cryocooler rest conditions and b) generating a force linearly proportional to the elongation or compression of the spring that acts toward bringing the piston back to the centered position under operating conditions.

The springs provide for more stable, predictable and controllable operation in that the gas pressure in the pneumatic drive volume acts against the static force of the spring that is not dependent on temperature. As compared to having no spring and controlled gas pressure both above and below the piston that may result in oscillation of the valves in response to the proportional control feedback to be discussed below, the more stable operation reduces the amount of gas required to drive the system. As opposed to having no spring, the spring can significantly reduce the energy requirements of the pneumatic drive mechanism. Having high pressure gas valved to only one side of the piston also highly reduces energy consumption as opposed to having high pressure valving to each side of the piston as in FIG. 5. Thus, having a spring and high pressure gas applied to only the distal drive chamber results in a reduced power consumption that would otherwise result in having high pressure control to both chambers with no spring.

Purposes of the spring are to:

1) Maintain a fixed reference rest position for the piston and displacer assembly.
2) Introduce a biasing component to the piston and displacer force balance equation that improves the position controllability of the displacer as well as the range of controllable motion profiles that can be executed with different pressure levels and pressure variation over time of the upper drive chamber and the refrigeration volume. With the pressure profile of the upper drive chamber being regulated by the drive valving while that of the refrigeration volume is regulated by the independent actuation of the refrigeration volume valving, instances occur when the force balance on the piston and displacer does not permit a proper control of the position of the displacer without the spring. For instance, in absence of the spring, the piston and displacer could not be moved toward the distal drive chamber (i.e., upward direction of motion when referencing FIGS. 3, 4 and 5) when the refrigeration volume is kept at a low pressure level (e.g., suction pressure level).
3) Reduce the fluid consumption required to actuate the pneumatic drive by either using a single drive valve (e.g., FIGS. 3 and 4) or using two drive valves (e.g., FIG. 5) at a reduced valve actuation rate.

Figure 10:
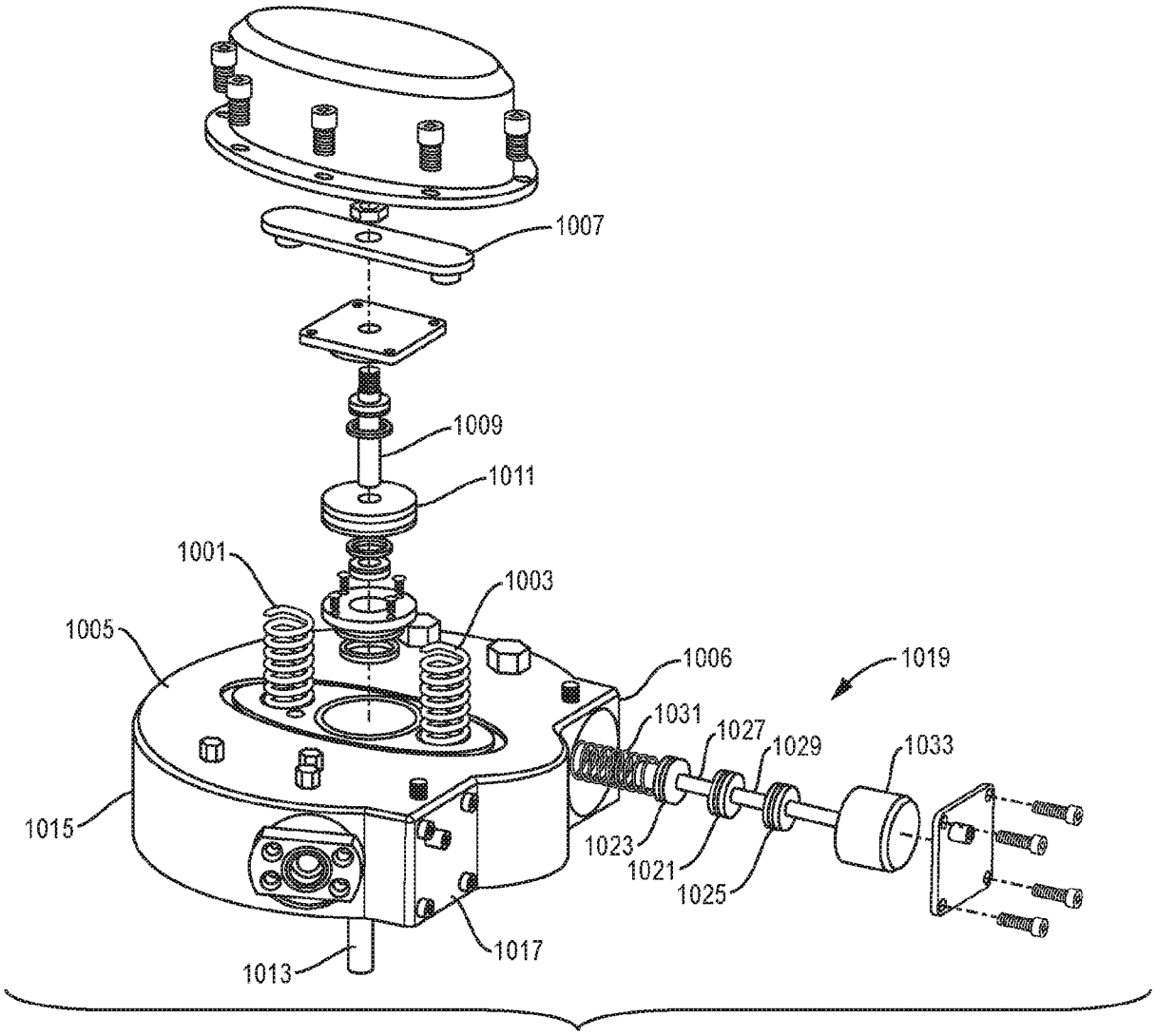
FIG. 10 is an exploded view of another alternative pneumatic drive in accordance with the invention.

The spring can be either positioned at the interior of any of the drive chambers or at the outside of the drive chambers while still being connected to the piston and displacer assembly (e.g., FIG. 10).

The spring can consist of one single spring element or alternatively more than one spring element positioned in parallel (e.g., FIG. 10) to reduce the overall dimensional volume of the drive system or to improve the alignment between the piston and displacer assembly and the refrigeration and drive chambers.

In all configurations, the size of the drive chambers (height and diameter) and the stiffness of the springs are optimized based on force balance calculations to ensure the best compromise between the displacer position controllability and the drive helium gas consumption.

All of the above configurations may include elastomeric bumpers to dampen any collision that could occur between the piston/displacer assembly and the drive chamber/cryocooler cylinders assembly, but the proportional control described below should make bumpers unnecessary.

All the configurations described above rely on the use of electronically controlled valving: either one or two valves to control the helium gas flow in and out of the pneumatic drive chambers and an additional valve that regulates the helium gas flow into the TD refrigeration volume. The drive valves may be proportional electronic spool valves to ensure precise proportional control of the pressure levels inside the drive chambers or also on/off valves as long as the frequency of actuation of the latter are sufficiently high to ensure proper controllability. On the other hand, the electronic valve serving the TD refrigeration volume could be either of the proportional spool type or an ON/OFF solenoid valve.

The control algorithm of the pneumatic drive is designed to control the cryocooler electronic valves based on one or more active feedback signals (the displacer/piston position signal and, possibly, a combination of position and pressure signals).

Figure 6A:
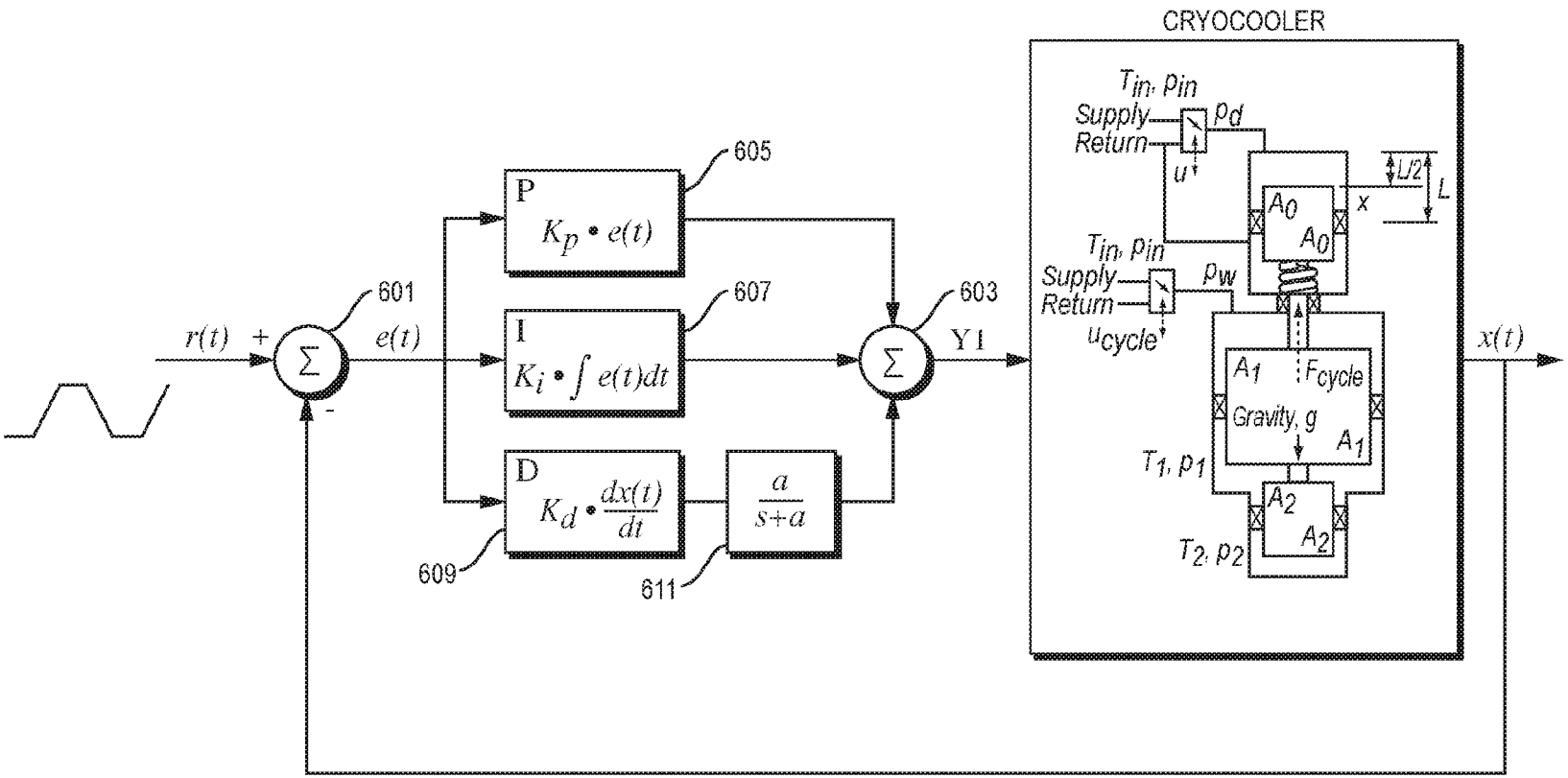
FIG. 6A illustrates a PID controller as applied to the present invention.

FIG. 6A shows a PID controller schematic as applied to the above-described embodiments. A desired displacement profile of the displacer with time is stored as r(t) in the controller. The difference between the displacement defined in that profile and measured displacement x(t) is determined at the summer 601 to produce the error signal e(t). That error signal may be applied to each of the P, I and D algorithms 605, 607 and 609. The derivative output may be passed through a low pass filter 611 to reduce noise. The outputs of those algorithms are summed at 603 to determine the control signal Y1 applied to the valve 137 to control the motion of the displacer. It has been determined that adequate response is obtained by relying only on the proportional control element 605 of the controller, setting $K_i$ and $K_d$ to zero. However, the I and D algorithms 607 and 609 may also be included.

Figure 6B:
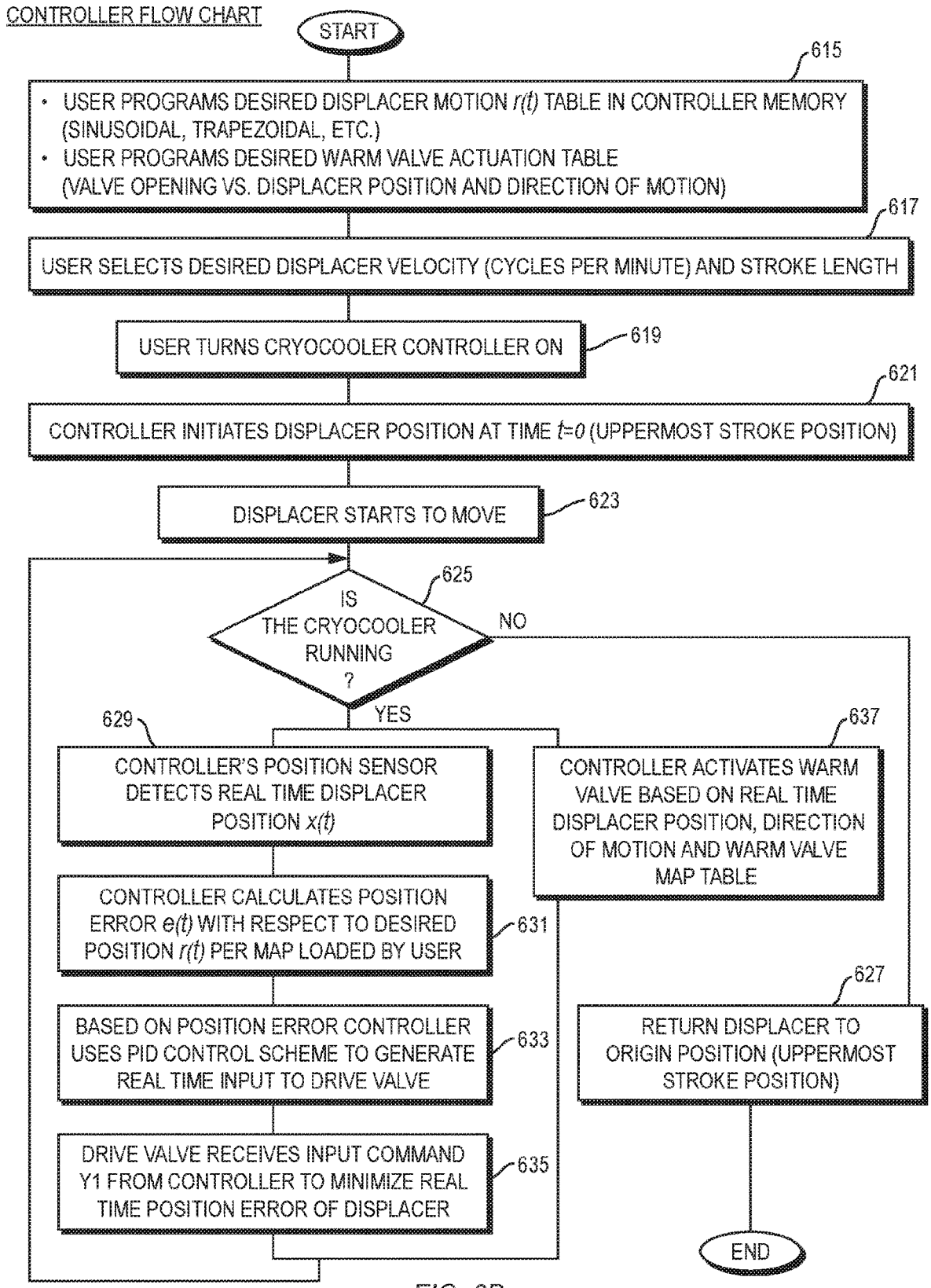
FIG. 6B is a flowchart of the operation of the electronic controller in one embodiment of the invention.

FIG. 6B illustrates a controller flowchart showing overall operation of the controller to provide the signals Y1 and Y2 in the pneumatic drive and TD pressure control. At 615, a user programs the desired displacer motion r(t) in a table in the controller memory. For example, a sinusoidal, trapezoidal or other profile may be programmed. The user also programs the desired warm valve actuation table profile, specifically the degree of valve opening versus displacer position and direction of motion. At 617, the user selects a desired displacer velocity in cycles per minute and stroke length. At 619, the user turns on the cryocooler controller 139. At 621, the controller initiates the displacer positioned at time t=0 at the uppermost stroke position by opening the valve V1 fully to the helium return line such that the spring forces the piston and displacer upward. At 623, the controller introduces high pressure helium from the supply line through the valve V1 to begin displacer movement downward. If the cryocooler is determined to be not running at 625, the displacer is returned to the original uppermost position at 627 by opening valve V1 to the exhaust pressure and operation ends.

With a running cryocooler, the system generates the control signal Y1, through four steps 629, 631, 633 and 635, which correspond to the PID controller operation of FIG. 6A. Simultaneously, the signal Y2 to drive the warm valve V2 is generated at 637. In the PID controller, at 629 the position x(t) is received from the position sensor 141. The controller 139 calculates the position error e(t) with respect to the programmed desired displacer position r(t) at 631. Based on the position error, the controller uses the programmed PID control scheme of 605, 607 and 609 to generate a real-time input Y1 to drive the valve V1 at 633. The drive valve V1 receives the input command Y1 from the controller at 635 to minimize real-time position error of the displacer through full stroke.

Although the PID controller could also be used to control the valve V2 with signal Y2, such precise control has not been found necessary. Instead, the controller 139 activates the warm valve V2 based on the real-time displacer position x(t), direction of motion and the programmed warm valve actuation table. Even though the control is not proportional, it is preferred that the valve V2 be a proportional valve to allow continuously variable control of the gas flow into the warm end of the TD volume to enable, for instance, gradual opening of the V2 valve. Alternatively, a simple on/off directional valve could be used, allowing only a rectangular profile of valve control or, if the frequency of actuation is high enough, enable gradual opening of the valve through on/off modulation.

Although proportional control of proportional valves has been described, the proportional control may be obtained with an on/off valve capable to be operated at high frequency (e.g. at least 1/20 ms=5 Hz). In that case, the valve would be opened and closed with the frequency and duty cycle required to modulate the gas flow to follow a piece-wise continuous profile through displacer/piston stroke that corresponds to opening a proportional valve to desired levels.

It can be seen that the term proportional is used in different senses with respect to the controller and with respect to the valve. In the case of control, a drive signal may be obtained, as in the case of Y2, by simply following the profile programmed into the controller, for example, in a feed forward system. However, more precise proportional control is obtained through the feedback provided by a PID controller as in the proportional control of the signal Y1. The valve itself is a proportional valve (which term includes servo valves) if it allows for a continuously variable flow or pressure control in response to the variable electrical input signal. However, even a valve that is not itself a proportional valve, that is a valve that is merely an on/off directional valve, can provide a proportional control with high frequency operation in response to proportional control of the PID controller.

The valve controller 139 may be an element of an overall cryocooler controller, or it may respond to an overall controller to use any of multiple pressure and displacer motion profiles depending on input parameters received from the main cryocooler controller. The drive controller can adapt the displacer motion and the helium flow in and out of the cryocoolers depending on real-time system inputs that may be fed to it from the main controller.

Figure 7A:
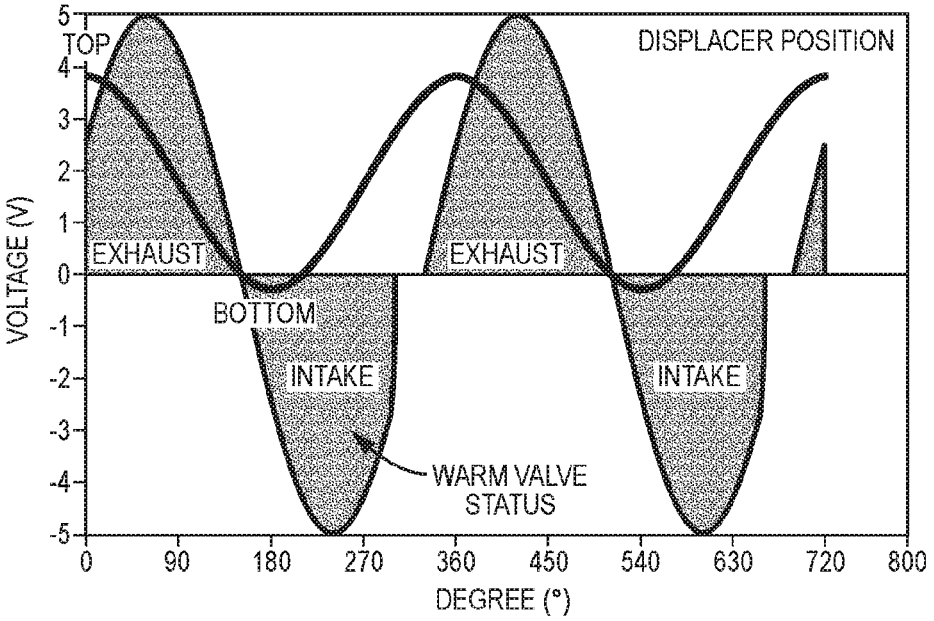
FIG. 7A illustrates displacer position and valve exhaust and intake timing in a conventional GM cycle refrigerator that may also be implemented in the refrigerator of the present invention.
Figure 7B:
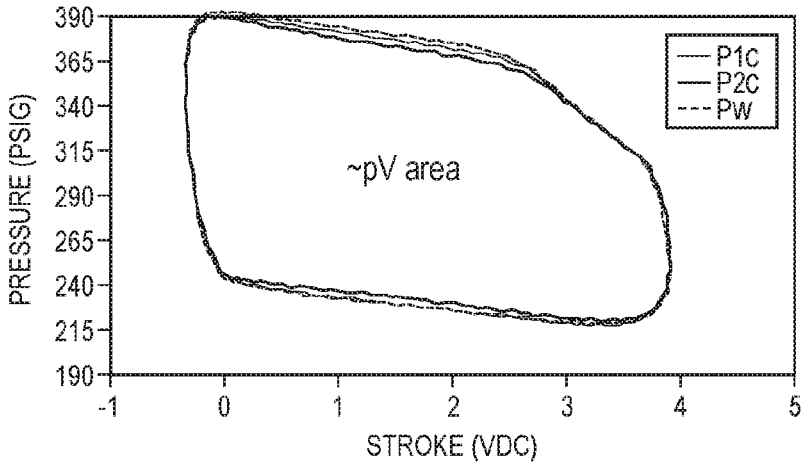
FIG. 7B illustrates a PV diagram of a conventional GM refrigerator that may also be implemented with the present invention.
Figure 8A:
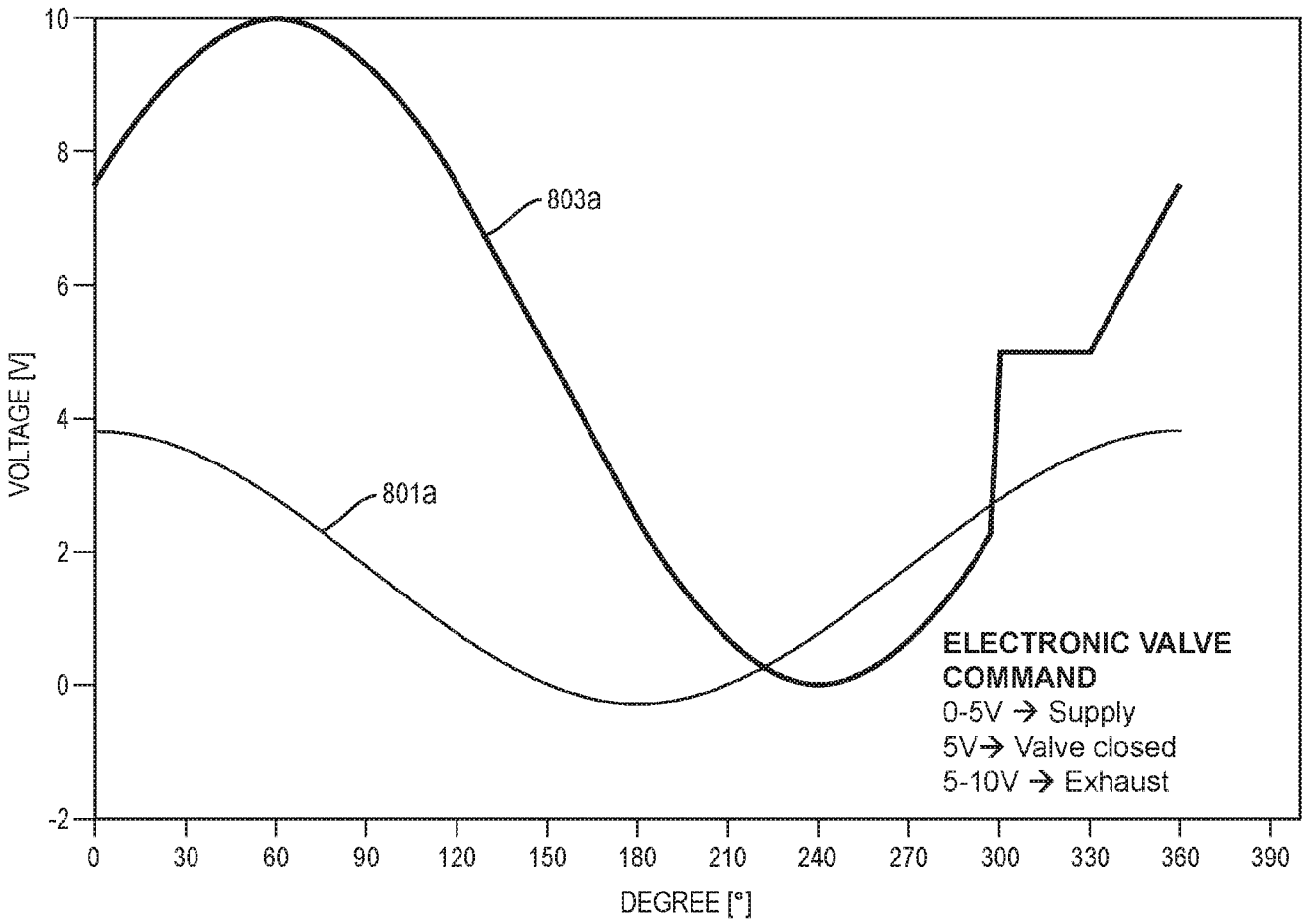
FIGS. 8A-8F illustrate example displacer position and valve timing profiles that may be implemented in the system.
Figure 8B:
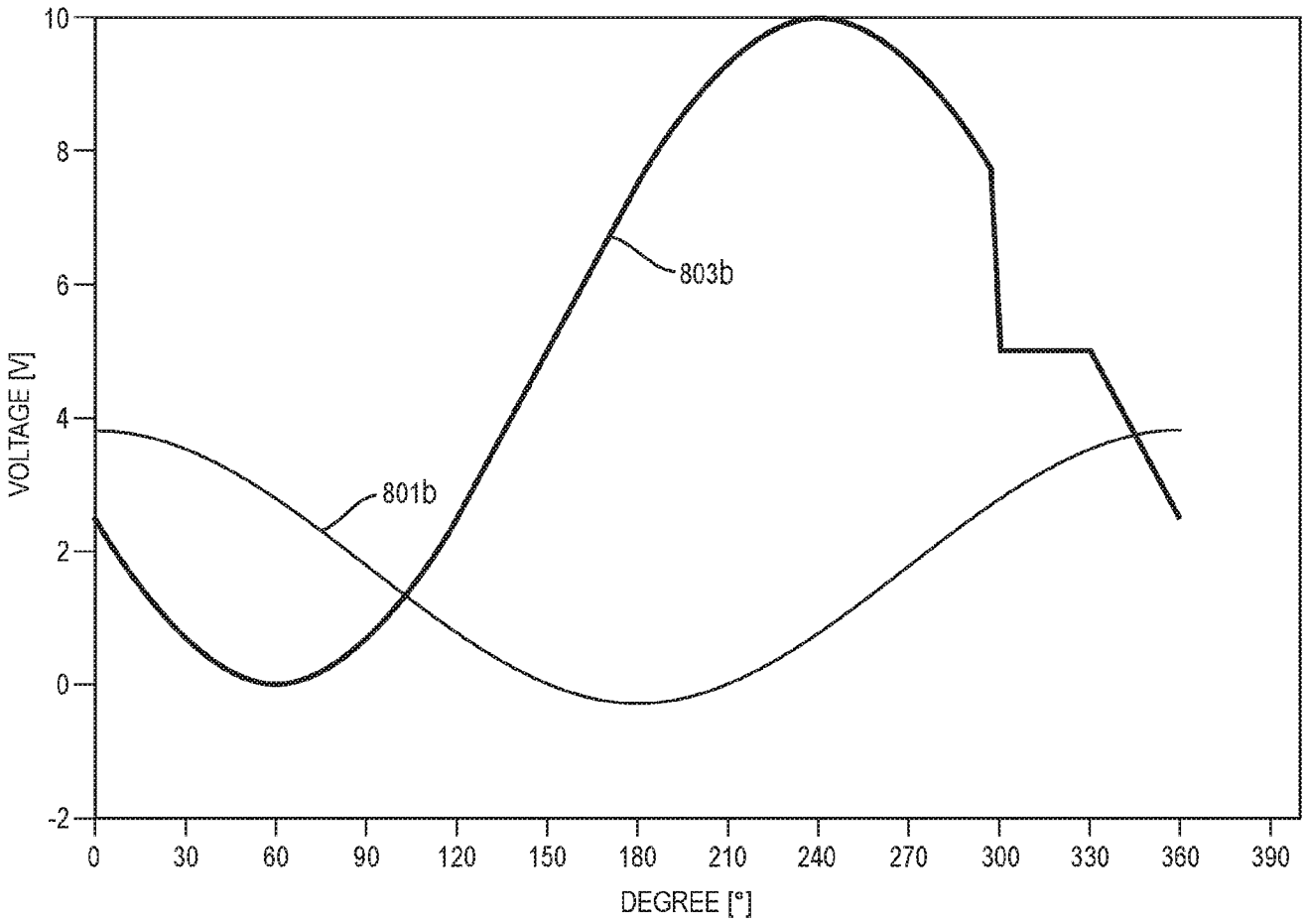
Figure 8C:
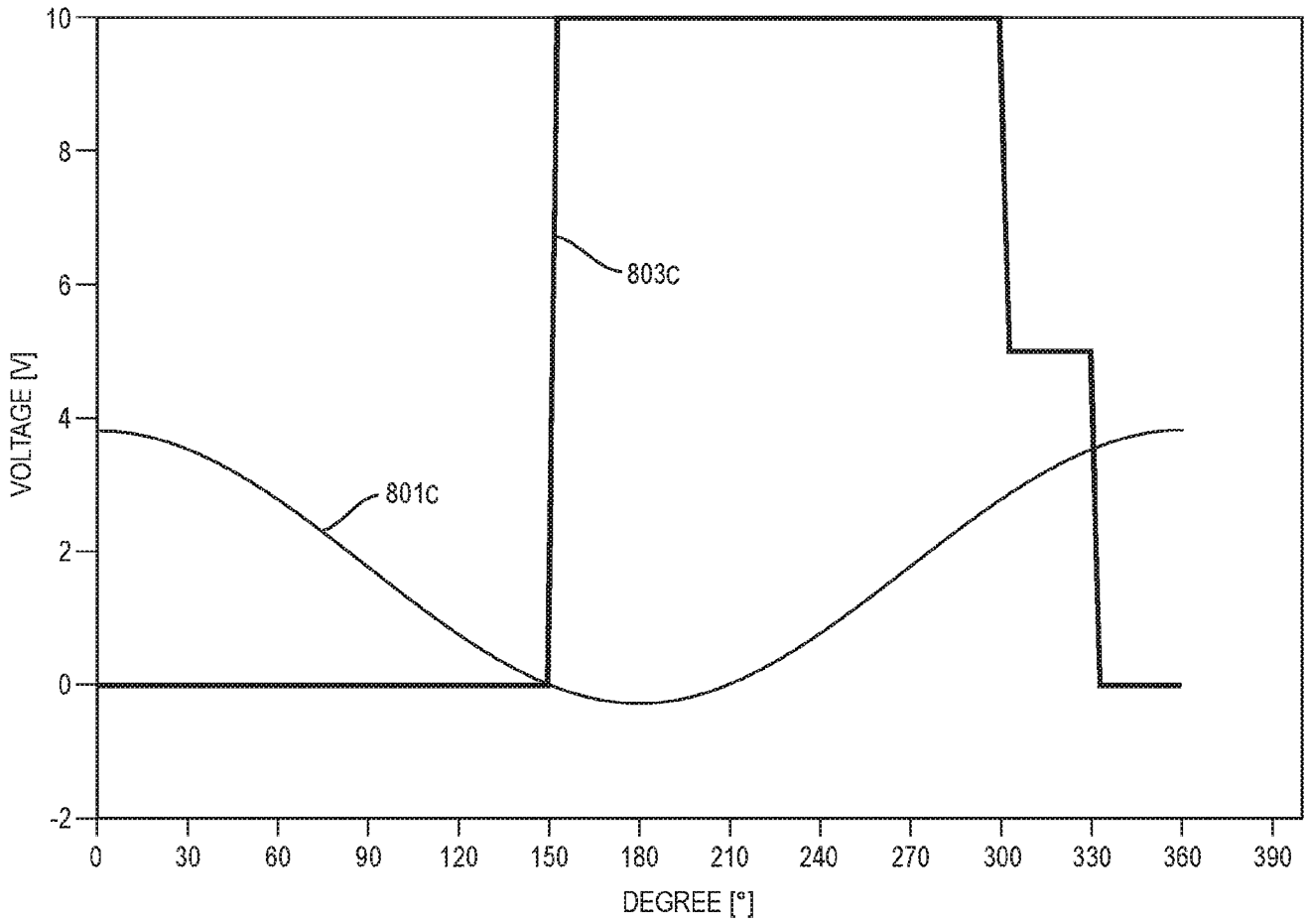
Figure 8D:
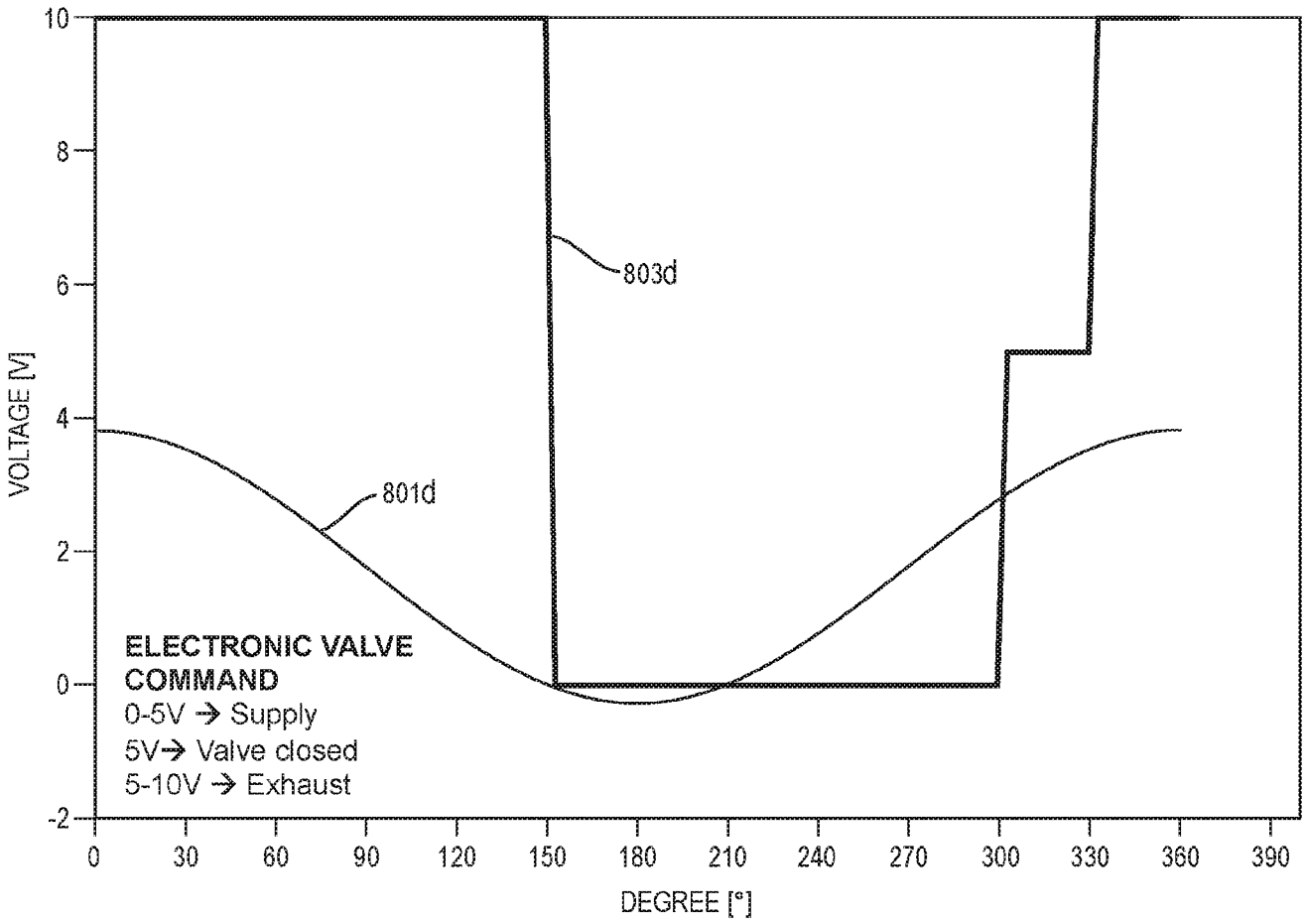
Figure 8E:
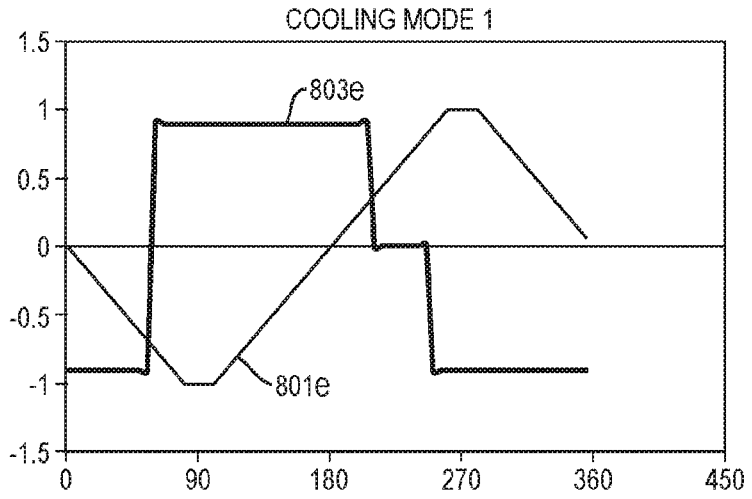
Figure 8F:
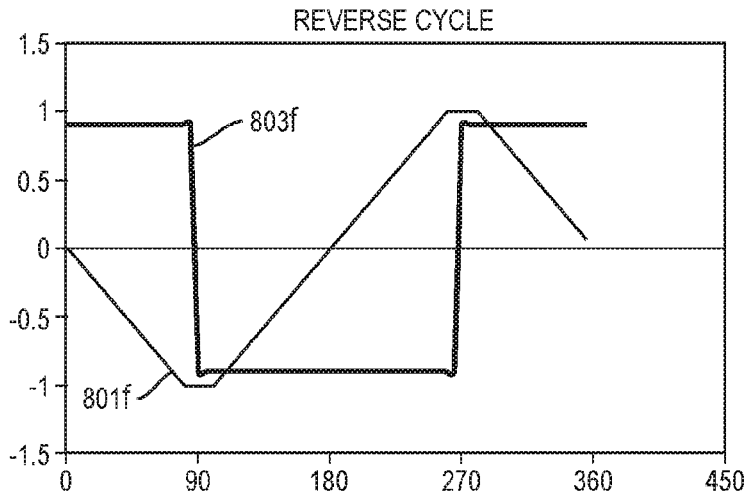

FIGS. 7A and 7B illustrate the typical operation of a motor driven GM cycle refrigerator. As shown in FIG. 7A, the displacer is driven by the rotary motor in a sinusoidal motion 701. The supply valve opens, for example, during the time 703 and closes during the time 705. After a brief dwell at 707 with both valves closed, the exhaust valve opens over 709 and closes over 711. The refrigeration cycle then begins again. The resultant pressure volume diagram can be seen in FIG. 7B, showing pressure for the first stage cold end, second stage cold end and warm end locations within the cold finger. The cryopump embodying the disclosed pneumatic drive and control may provide for identical operation by defining the profile of 703, 705, 709 and 711 for control of the refrigeration volume warm valve 113 and by defining the displacer position profile 701. However, the disclosed system provides for much greater flexibility. For example, FIGS. 8A through 8F show different displacement and refrigeration volume warm valve profiles 801 and 803, respectively. In each of FIGS. 8A-D, the specific refrigeration volume valve used is closed at 5 volts such that gas is supplied to the warm end of the TD expansion volume at voltages less than 5 volts and exhausted from the warm end of the TD volume at voltages greater than 5 volts. Other proportional valves may require different actuation commands FIGS. 8C and 8F result in reverse, heating operation of the refrigerator.

Figure 9:
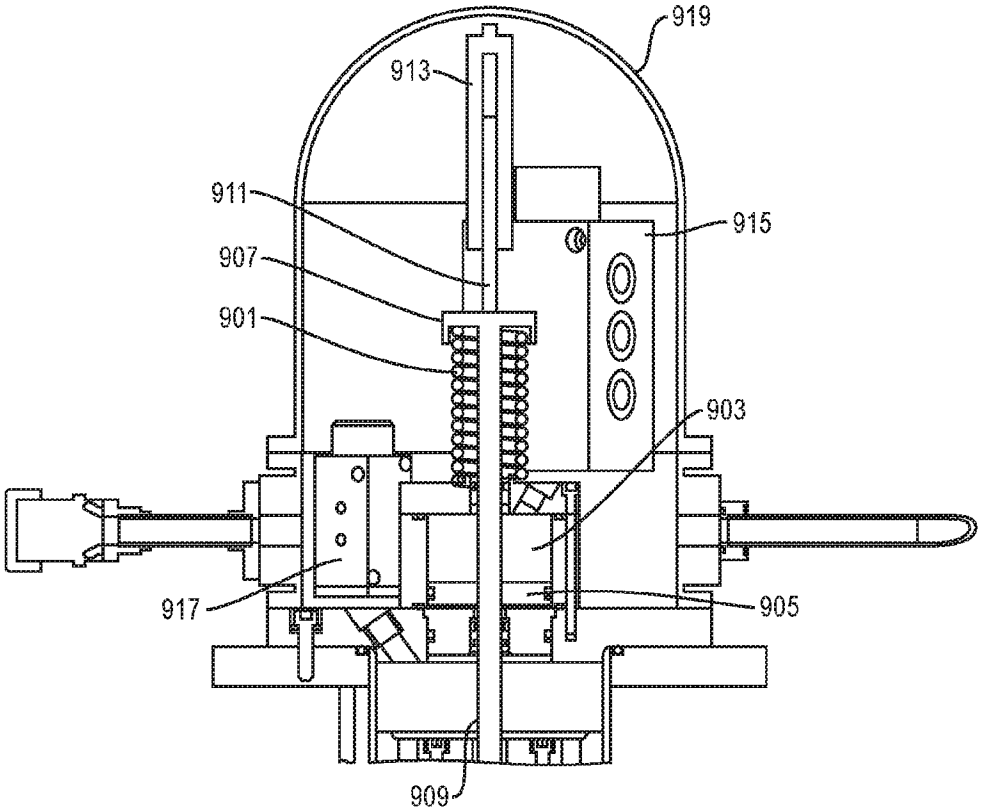
FIG. 9 is a cross-sectional view of an alternative pneumatic drive in accordance with the present invention.

FIG. 9 illustrates an alternative pneumatic drive in which the preloading spring 901 is mounted outside of the pneumatic drive chamber 903. The spring 901 is positioned between the top end of the drive chamber 903 and a disk 907 at the end of the drive shaft 909 that couples the piston 905 to the displacer piston of the cryocooler. The spring forces the piston toward the distal end of the pneumatic drive volume at rest. As illustrated in FIG. 9, the spring is in compression as a result of high pressure in the upper drive chamber. A pin 911 extends from the disc 907 into the position sensor 913. Valve 915 controls the supply and return from the warm end of the TD volume and a valve 917 controls supply and return to the distal chamber of the drive volume. The proximal chamber of the drive volume may be coupled to the return line as in the embodiment of FIG. 4. The entire pneumatic drive assembly is enclosed in a sealed chamber of dome 919 that ensures that any working fluid possibly leaking out of the valves remain within a closed pressurized loop without being dispersed in the atmosphere. The use of helium-tight valves would make the presence of the sealed chamber unnecessary.

FIG. 10 illustrates another embodiment similar to that of FIG. 9 in that the return springs are positioned outside of the pneumatic drive volume. However, the single spring element of FIG. 9 is replaced by dual spring elements 1001 and 1003 to reduce the height of the assembly. Those springs are positioned between the top plate 1005 of a housing 1006 that surrounds the drive volume and valves and the retention arm 1007 coupled to the rod 1009 and pneumatic drive piston 1011. A further rod shown only below the module at 1013 couples to the piston 1011 within the pneumatic volume 1015. The housing 1006 also retains the valve 1017 for supply and return to the TD volume and the valve 1019 to the pneumatic drive volume, the latter being shown in exploded view. The particular proportional valve 1019 shown is a spool valve as will be described below. The spool valve includes a central collar 1021 between end collars 1023 and 1025 to define respective annuluses 1027 and 1029 within a valve cylinder, not shown in FIG. 10. The spool is centered by springs including spring 1031 and another spring within a control motor 1033. The motor drives the spool proportionally in response to a valve control signal as will be described in greater detail below.

Figure 11A:
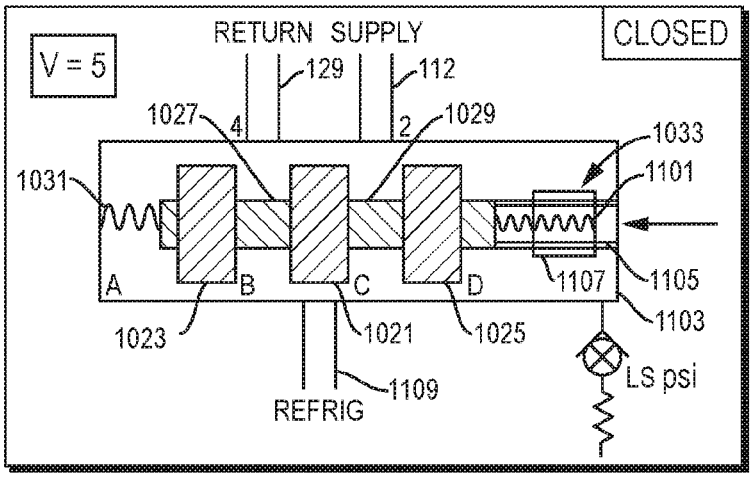
FIGS. 11A-C illustrate one example of a proportional valve for use in accordance with the present invention in closed, fully-open-supply, and fully-open-return states.
Figure 11B:
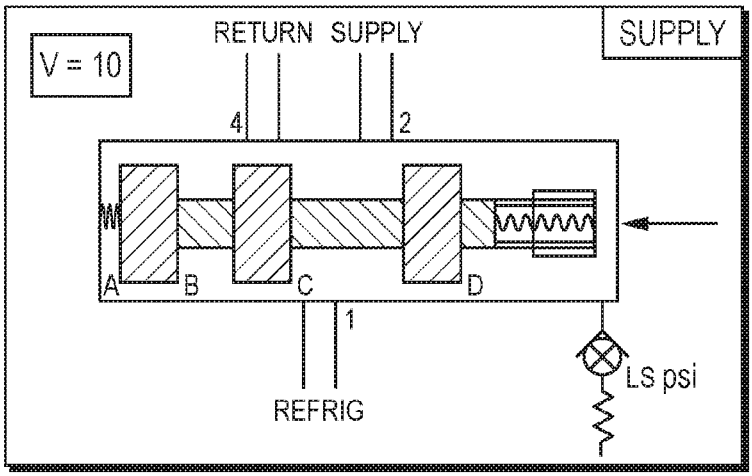

FIGS. 11A, B and C illustrate operation of the proportional valve V1 or V2. As illustrated in FIG. 11A, the spool comprises three collars 1021, 1023 and 1025 on a center rod 1027. In FIG. 11A, the spool is held in a neutral position by the fluid pressure balance and the opposing springs 1031 and 1101, each of which has an end fixed to the valve housing 1103. Axial position of the spool is maintained by voltage control of a moving coil 1105 within a stator magnet 1107 that is fixed to the housing 1103. In the valve design illustrated, the neutral position of FIG. 11A is maintained with a 5 volt input to coil 1105. In the neutral position, the collar 1021 blocks any gas flow to or from the refrigerator port 1109. High-pressure gas is supplied to the volume 1029 from the supply line 112 and the volume 1027 is held at the low pressure of the return line 129. To supply high pressure gas to the refrigerator, a voltage greater than 5 volts is applied to the coil 1105 to cause the spool to move to the left, compressing spring 1031 and extending spring 1101. FIG. 11B shows the spool at the extreme left with the highest applied voltage of 10 volts opening the refrigerator port 1109 fully to the supply line at 1102. However, with an applied voltage anywhere between 5 volts and 10 volts, the spool 1021 will only partially open the port 1109 to the high pressure volume, thus controlling the flow through the refrigerator port 1109 and the pressure in the refrigerator proportionately to the applied voltage. In the case of the drive valve 137 of FIG. 1, the pressure in the upper drive chamber 135 would be proportionally controlled by the applied voltage. In the case of the warm valve 113, the flow into the TD volume would be proportionally controlled relative to applied voltage.

Figure 11C:
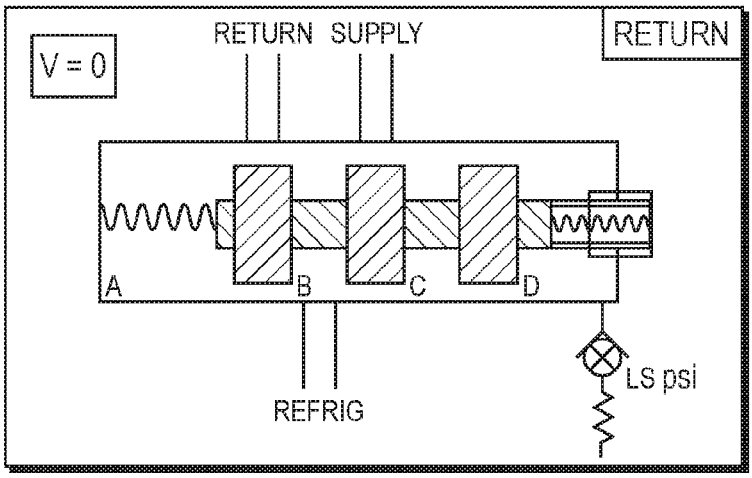

FIG. 11C shows the spool moved to the extreme right position with applied voltage of 0V. In this state, the port 1109 to the refrigerator is fully open to the low pressure volume 1027 to exhaust gas from the refrigerator, either from the drive volume, in the case of the drive valve 137, or the TD volume in the case of the warm valve 113. Again, the position of the spool is proportionately controlled relative to the applied voltage between 0 and 5 volts to control the flow from the refrigerant port 1109 and thus the pressure in the refrigerator.

Plant simulations and experimental results based on the implemented drive architectures based on a simple PID control loop and a piston position feedback signal indicate that the control solution is adequate to ensure a high degree of piston controllability (position error less than 5% of full stroke length). The adoption of more sophisticated control algorithms (e.g., feed-forward control schemes) or additional sensors (e.g., pressure sensors) could be made for the purpose of further optimizing the TD cycle and minimizing the position error.

Because a feedback control system is always compensating for an error condition, the system under control is not maintained in a steady state condition, but instead typically oscillates around a particular set point. The error signal and oscillation are reduced with use of the spring. With or without the spring, there may be an error band around the optimal set point condition within which the controller does not respond to input signals in order to prevent the controller from driving the system into an unfavorable oscillation condition or some other negative behavior. In the case of a GM refrigerator that is under pneumatic control, there is little room for error with regards to the displacer travelling too far. If it attempts to travel too far, it will hit either the top or the bottom of the refrigeration cylinder. Thus, any feedback control system must take into account the size of the error that may be made by the control system, and set the desired stopping position of the displacer somewhat short of the top or bottom of the cylinder such that if the displacer overshoots by the error amount, it still does not physically hit the bottom or top of the cylinder. Not utilizing the full stroke available for the displacer does however diminish the overall thermodynamic efficiency of the cryo-cooler, and is thus undesirable. An alternative controller applies the concept of adaptive feed-forward control to maximize the allowable displacer stroke, thus maximizing refrigeration efficiency of the cryo-cooler.

In order for a feed forward algorithm to successfully control any system, the response of the system to input variable changes must be known. This is distinctly different than a feedback control system which is reactive to the system's behavior, and changes input variables in response to an error condition. The feed forward control system monitors the system and based upon knowledge of real-time system parameters, makes adjustments to input variables to achieve a desired predictive system state. The control system may monitor important system parameters such as temperature, displacer position, displacer velocity, displacer acceleration, helium pressure, etc., and based upon those parameters adjusts controllable input parameters to achieve the desired system condition of having the displacer motion profile trace out the optimal trajectory. The ability of this concept to work in practice requires that the response of the system be predictable. In practice, this means that the control system should be capable of learning the output response of the system to changes in input variable changes. This is required since over time the response of the system will change, and thus an adaptive feed forward algorithm is required. In an adaptive feed forward algorithm, the controller learns the response of the system to changes of the input variables, and thus effectively "calibrates out" effects due to slowly changing response functions. A combined feed-forward and feedback controller can provide the benefits of both types of control system at the expense of computational complexity. However, today's low priced processors can easily handle the computational load that is required to implement a combined control system.

Figure 12:
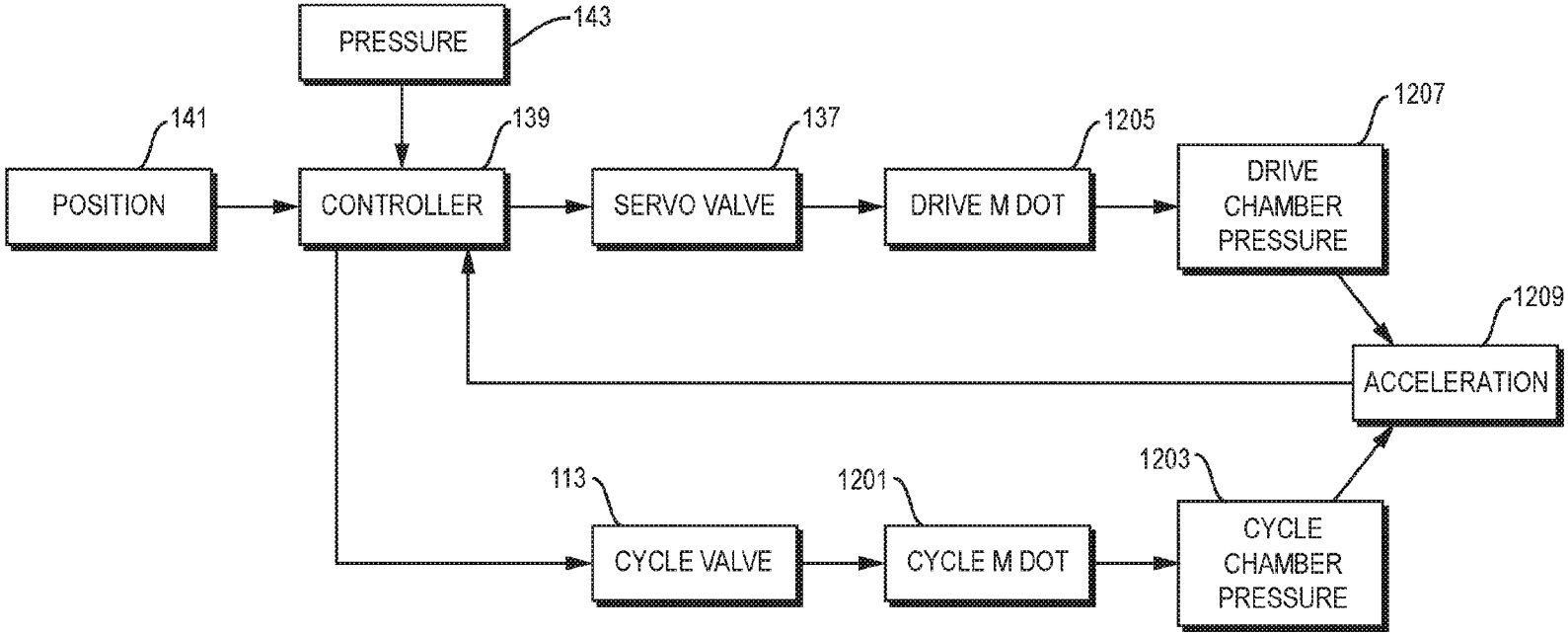
FIG. 12 illustrates a block diagram of a feedforward electronic controller that may be used in implementing the present invention.

A schematic representation of a feed forward algorithm is shown in FIG. 12.

In this embodiment, the refrigeration volume valve 113, labeled here as cycle valve 113, is controlled by the controller 139 in a simple feed forward algorithm. The controller controls the valve 113 to obtain a mass flow "m dot" that controls the refrigeration volume pressure 1203, labeled here as cycle chamber pressure. In this feed forward control, the controller 139 relies upon the sensed position 141 of the piston and displacer assembly at time t−1 to anticipate the required "m dot" value at time t.

An adaptive feedforward control is used to control the drive valve 137, labeled here as a servo valve. The control results in a mass flow "m dot" to control the drive chamber pressure 1207. Together, the cycle chamber pressure and drive chamber pressure control acceleration of the piston and displacer assembly 1209. For adaptive feedforward control, the controller responds to the position sensor 141. It likely will also respond to calculated position errors occurred during previously completed cycle loops and the sensed pressure 143. Alternatively, the pressure might be calculated based on the real-time calculated acceleration of the piston and displacer assembly using only a position sensor. Sensed pressure could be of only the cycle chamber pressure or both the cycle chamber and the drive chamber pressures.

In FIG. 12 we exemplify the schematic of a feed forward algorithm that uses information of the real time cycle (refrigeration) chamber pressure at time t to determine the acceleration and position of the piston and displacer assembly required at time t+1. Based on the cycle chamber pressure at time t the controller 139 calculates the required piston and displacer assembly acceleration and position at time t+1 and sends a corresponding input command to the servo valve 137. The latter responds by regulating the fluid flow to the drive chamber to opportunely generate the fluid pressure levels required to establish the desired acceleration of the piston and displacer assembly at time t+1.

To control the cycle valve 113, the controller reads an input table provided by the user (who is able to modify the table according to the specific refrigerator and application needs). The input table contains the information that correlates the position and direction of motion of the piston and displacer assembly to the degree of opening of the cycle valve (i.e., the fluid mass flow into the cycle chamber). In this case the action of the controller is to read the real time position of the piston and displacer assembly, calculate the direction of motion of the latter by comparing the current position against those during previous time steps (t−1, t−2, t−3, etc.), read the cycle valve state in the input table, and send the corresponding command to the cycle valve.

In addition to providing feed forward control of a pneumatically driven refrigerator, we include diagnostics related to both the feedback control stability and the feed forward control stability which are indicative of refrigerator wear and general health.

As previously described, conventional GM refrigerators use a motor drive scotch-yoke mechanism to drive the displacer of the refrigerator. The pneumatically driven refrigerator eliminates the scotch-yoke mechanism, and its direct connection to the valve driving mechanism, providing the advantages described in the earlier section. The combination of a pneumatic drive with electronic valves enable the following features that are not currently attainable with any of the existing conventional GM refrigerators:

1) Capability to electronically map the stroke length of the displacer

2) Capability to control the pressure levels inside the refrigerator's TD chamber. Specifically, reducing the pressure variations experienced by the TD cycle by opportunely controlling the amount of helium flowing through the TD chamber;

3) Capability to electronically map the movement of the displacer by imposing chosen kinematic space-time trajectories (sinusoidal, semi-sinusoidal, trapezoidal, etc.). This includes the possibility to impose asymmetric motion profiles characterized by varying velocities at different points of the displacer trajectory which aim at optimizing the TD efficiency of the cycle;

4) Electronically map the timing between the position of the displacer and the helium flow through the refrigerator to optimize the TD efficiency of the cycle (i.e., the available cooling capacity vs. the total helium consumption) and also operate the refrigerator as a heat engine (i.e., producing heat instead of cooling). Certain GM refrigerators currently available in the market can already operate as heat engines; however, this implementation differs in that the design does not limit the timing described above to a limited number of timings (generally two) but can electronically map the system to any arbitrary timing value;

5) Capability to electronically map the cryocooler in such a way to modify its cooling capacity and efficiency while maintaining a fixed refrigerator speed (cycles per minutes) and trajectory of the displacer. This feature is expected to be relevant to MRI and NMR applications where the need exists for varying the cooling capacity of the cryocooler while maintaining the refrigerator operating at constant speed and trajectories. This design enables such a use without the need of additional hardware components in the receiving system or the sacrificing of the system energy efficiency.

6) Use of a mechanical spring or magnets to improve the controllability of the pneumatically driven displacer trajectory.

7) The system can be augmented by a sophisticated feed-forward control algorithm that allows for balancing the forces dynamically, preventing the displacer from hitting the top or bottom of the cylinder while ensuring maximum energy efficiency, and additionally allowing the stroke length of the displacer to be adjusted to allow optimization of refrigeration capacity and match the capacity to the application need, i.e., heat load.

8) Proper tuning of the control algorithm, along with judicious choice of component parts, allows the system to address all the problems described in the background.

The electronic controller of the present application may be just hardware, but is generally implemented in software in a hardware system comprising a data processor and associated memory and may include input output devices. The processor routines and data may be stored on a non-transitory computer readable medium as a computer program product. The controller may also be, for example, a standalone computer, a network of devices, a mobile device or combination thereof.

The teachings of all patents, published applications and references cited herein are incorporated by reference in their entirety.

While example embodiments have been particularly shown and described, it will be understood by those skilled in the art that various changes in form and details may be made therein without departing from the scope of the embodiments encompassed by the appended claims.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A cryogenic refrigerator comprising:

a refrigeration volume having warm and cold ends;

a reciprocating displacer within the refrigeration volume;

a pneumatic drive volume at the warm end of the refrigeration volume;

a drive piston in the pneumatic drive volume coupled to the displacer;

refrigeration volume valving controlling cyclic supply and exhaust of a pressurized refrigerant gas to and from the warm end of the refrigeration volume;

drive valving providing supply and exhaust of drive fluid to and from the pneumatic drive volume to apply driving force to the drive piston;

magnets applying force to the piston in addition to the driving force applied by the drive fluid; and an electronic controller controlling the drive valving with a drive control signal that varies through stroke of the drive piston to cause the drive piston to follow a programmed displacement profile through stroke of the drive piston.

2. The cryogenic refrigerator of claim 1 further comprising a displacement sensor responsive to movement of the drive piston or displacer to provide a displacement signal, the electronic controller minimizing error between the displacement signal and the programmed displacement profile through stroke of the drive piston.

3. The cryogenic refrigerator of claim 1 wherein the drive valving is proportional drive valving that provides continuously variable supply and exhaust of drive fluid in proportion to an electric drive control signal from the electronic controller.

4. The cryogenic refrigerator as claimed in claim 1 wherein the electronic controller opens and closes the drive valving to respective supply and exhaust lines at sufficient rate to provide variable control of pressure between supply and exhaust pressures in the pneumatic drive volume.

5. The cryogenic refrigerator as claimed in claim 1 wherein the drive piston separates the pneumatic drive volume into a proximal drive chamber proximal to the displacer and a distal drive chamber distal from the displacer, and the drive valving supplies and exhausts drive fluid to and from the distal drive chamber.

6. The cryogenic refrigerator as claimed in claim 5 wherein the drive valving further supplies and exhausts drive fluid to and from the proximal drive chamber and the proximal chamber is not in communication with the warm end of the refrigeration volume.

7. The cryogenic refrigerator as claimed in claim 5 wherein the proximal drive chamber is directly coupled to a drive fluid exhaust and not to the refrigeration volume.

8. The cryogenic refrigerator as claimed in claim 5 wherein the proximal chamber is in fluid communication with the warm end of the refrigeration volume.

9. The cryogenic refrigerator as claimed in claim 1 wherein the refrigeration volume valving comprises proportional valving that provides continuously variable supply and exhaust of refrigerant gas to the refrigeration volume in proportion to an electronic refrigerant control signal.

10. The cryogenic refrigeration as claimed in claim 1 where the drive fluid is valved from refrigerant supply and return lines.

11. The cryogenic refrigerator as claimed in claim 1 wherein the electronic controller further provides adaptive feedforward control.

12. The cryogenic refrigerator as claimed in claim 1 wherein the electronic controller provides feedback control.

13. The cryogenic refrigerator as claimed in claim 1 further comprising a sealed chamber enclosing the refrigeration volume valving and the drive valving.

14. A method of cryogenic refrigeration comprising providing a reciprocating displacer in a refrigeration volume coupled to a reciprocating piston in a pneumatic drive volume;

supplying and exhausting pressurized gas refrigerant to and from a warm end of the refrigeration volume;

with an electronic controller, controlling drive valving to provide supply and exhaust of drive fluid to and from the pneumatic drive volume to apply driving force to the drive piston, the electronic controller providing to the drive valving an electronic drive control signal that varies through stroke of the drive piston to cause the drive piston to follow a programmed displacement profile through stroke of the drive piston; and using magnets to apply a force to the drive piston.

15. The method of claim 14 further comprising sensing position of the drive piston or displacer to provide a displacement signal, the electronic controller minimizing an error between the displacement signal and the programmed displacement profile through stroke of the drive piston.

16. The method of claim 14 wherein the drive valving is proportional drive valving that provides continuously variable supply and exhaust of drive fluid in proportion to an electric drive control signal from the electronic controller.

17. The method as claimed in claim 14 wherein the electronic controller further provides adaptive feedforward control.

18. The method of claim 14 where the electronic controller provides feedback control.

* * * * *